US005566425A

United States Patent [19]

Mohr et al.

[11] Patent Number: 5,566,425

[45] Date of Patent: Oct. 22, 1996

[54] PROCESS AND DEVICE FOR THE DEPOSIT OF A FIBER SLIVER END ON A FLAT CAN

[75] Inventors: Bernhard Mohr, Titting; Michael Ueding, Ingolstadt; Michael Strobel, Eichstätt; Albert Kriegler, Rottenegg, all of Germany

[73] Assignee: Rieter Ingolstadt Spinnereimaschinenbau AG, Ingolstadt, Germany

[21] Appl. No.: 275,768

[22] Filed: Jul. 15, 1994

[30] Foreign Application Priority Data

Jul. 24, 1993 [DE] Germany ..... 43 24 948.5
May 13, 1994 [DE] Germany ..... 44 16 911.6

[51] Int. Cl.[6] ..... B30B 13/00

[52] U.S. Cl. ..... 19/159 R; 19/159 A

[58] Field of Search ..... 19/157, 159 R, 19/159 A, 160, 150; 57/90, 268, 281, 276, 265; 414/778

[56] References Cited

U.S. PATENT DOCUMENTS 4,526,095 7/1985 Rewitzer .
5,237,726 8/1993 Gartenmann et al. .

FOREIGN PATENT DOCUMENTS

0457099B1 5/1991 European Pat. Off. .
0468224A1 1/1992 European Pat. Off. .
4107309A1 10/1991 Germany .
2044304 10/1980 United Kingdom .

*Primary Examiner*—C. D. Crowder
*Assistant Examiner*—Larry D. Worrell, Jr.
*Attorney, Agent, or Firm*—Dority & Manning

[57] ABSTRACT

The instant invention relates to the deposit of the fiber sliver end after the filling of a flat can. It is the object of the invention to deposit and prepare the sliver end in the area of the filling station on a full flat can in order to facilitate automatic handling of the flat can during transportation as well as automatic handling of the sliver end on a spinning machine at the least possible cost. The invention assumes that the positions between outlet (15) of the rotary plate (12), severing device (18) and flat can (1) in relation to each other are adjustable and that an influence on the point of deposit of the sliver end and on the length of the sliver end results from this selected setting.

8 Claims, 7 Drawing Sheets

PROCESS AND DEVICE FOR THE DEPOSIT OF A FIBER SLIVER END ON A FLAT CAN

BACKGROUND OF THE INVENTION

Process for the deposit of the fiber sliver end on a flat can and device to carry out the process.

The instant invention relates to the deposit of the fiber sliver end after the filling of a flat can. The filling station for the flat can is a textile machine for spinning room preparation such as a carding machine or a draw frame. These machines are provided with a stationary rotary plate with a sliver guiding channel. During rotation of the rotary plate, fiber sliver is deposited cycloidally through this sliver guiding channel into a flat can. When the flat can is full the fiber sliver is severed and a sliver end is deposited on the flat can. The necessary degree of automation in feeding the sliver to machines for further processing in the spinning room is influenced considerably through the deposit of the fiber sliver end on the flat can.

With round cans, it is a known method to sever the fiber sliver after the filling process in such a manner that the fiber sliver hanging down on the round can hangs down in a random position at the can rim, whereby the length of the hanging sliver varies. As automation increased in spinning, it was a disadvantage in can transportation, as well as in the presentation of the round cans, that the band end must be located over the circumference of the can at a cost. Thus, delays in further processing occurred. In order to eliminate the disadvantages, holding devices to position the sliver end were installed at the can rim.

As the utilization of the flat can became more frequent, an economic solution to the deposit of the fiber sliver end was also sought. The technical solutions for the deposit of the sliver end known from the round can is in many aspects not transferable because of a different geometry and different handling characteristics of the flat can as it is being filled and in can replacement.

EP 457 099, FIG. 5, shows that a flat can is pushed away from the rotary plate after being filled and into a position in which it stands near the severing device. The sliver end on the full can lies in a random position on the end wall after being severed. A difficulty consisted in further processing that an increased cost is to be incurred in order to locate and grasp the fiber sliver end at the can rim or at the end wall of a flat can. A solution for flat cans is also shown in DE-OS 41 07 309. A holding device is provided at the end wall of the flat can and is able to hold a grasper. The grasper positions the sliver end on the flat can. This solution has the disadvantage that it must be possible to install an additional holding device for the fiber sliver end on each flat can.

In the state of the art it is accepted that the fiber sliver has a relatively great length tolerance. This length tolerance may result from the sliver severing system. The different lengths of the fiber sliver ends is normally shortened to the desired length through measures during the subsequent sliver end processing on can conveying vehicles or before the spinning machine so that it may then be fed automatically to the spinning machines.

OBJECTS AND SUMMARY OF THE INVENTION

It is a principal object of the instant invention to deposit and to prepare the sliver end on a full flat can in a defined manner in the area of the filling station in order to facilitate automatic handling of the flat can during transportation and of the sliver and on the spinning machine at the least possible cost. Additional objects and advantages of the invention will be set forth in part in the following description, or may be obvious from the description, or may be learned through practice of the invention.

The flat can is traversed under the rotary plate so that the fiber sliver is deposited cycloidally. The cycloidal deposit takes place from one end wall of the flat can to the other. A depositing path of this kind constitutes a fiber sliver layer. A full can has received a plurality of such layers of fiber sliver. The traversing speed of the flat can is synchronized with the delivery speed of the rotary plate. Start, operation, and braking of rotary plate and flat can are synchronized.

The process according to the instant invention is based on the idea that the positions between outlets of the rotary plate, the severing device, and the flat can can be adjusted and set in relation to each other, and that this selected setting influences the place of deposit of the sliver end and the length of the sliver end.

Starting with the stopped machine, flat can and outlet of the rotary plate have reached an adjustable stopped position. Starting with the stopped position of the flat can, the rotary plate outlet is always in a defined position in relation thereto so that the fiber sliver loops are pulled off in such a manner as the flat can is displaced that the fiber sliver comes to lie in the central area of the end wall at the end of the displacement path. During displacement of the flat can, fiber loops are pulled off from the last fiber sliver layer. In this process, the fiber sliver is drawn off over the upper can rim of the end wall. Since the loops are deposited in a circular form, the fiber sliver to be drawn off executes a traversing movement at the upper can rim of the end wall. This traversing of the fiber sliver takes place in the period of displacement. As the fiber sliver is drawn off, it also goes through the central area of the upper can rim of the end wall. A severing position of the flat can is reached when the flat can has passed the operating zone of the sliver severing device and the drawn-off fiber sliver is located in the central area of the upper can rim of the end wall.

In this position, the severing position, the fiber sliver is then severed. It becomes clear that the place of deposit of the drawn-off fiber sliver on the can rim of the end wall is influenced by the defined positioning of the rotary plate outlet and the subsequent displacement of the flat can.

The position between sliver severing device and severing position of the flat can and the length of the severed sliver end which hangs down from the upper can rim of the end wall is influenced.

The process has the advantage that furthermore design costs are extremely low and only serve to find the positions. The process can be retrofitted on existing textile machines.

An advantageous embodiment is based on the determination of the position of the outlet of the rotary plate and,with the position of the severing device being fixed, the ascertainment of the nearest possible displacement path thereto of the flat can where the fiber sliver is located in the central area of the upper can rim of the end wall. This design is advantageous because it requires only little machine installation surface, since the flat can requires a minimal displacement path. It is a further advantage here that the fiber sliver can be deposited in such a manner that the fiber sliver hangs down on the end wall in a position above the loops of the fiber sliver end. Due to the deposit via loops, the fiber sliver is fixed in its position as a result of adhesive friction, and this is advantageous in can transportation.

It is another advantageous aspect of the invention that in order to sever the fiber sliver, the flat can is held in the stopped position and the fiber sliver is severed in this position of the flat can between the pair of calendar rollers and the sliver guiding channel of the rotary plate. The flat can is then displaced into a receiving position, and in this process the severed fiber sliver end is pulled out of the sliver guiding channel and positions itself automatically in constant length at a defined position of the can rim of the end wall.

Thereby the fiber sliver end advantageously need not be unwound from the sliver loops deposited in the flat can so that the quality of the deposited sliver is not affected. Positioning is carried out at low cost and without a holding device. It is a further advantage that the length of the fiber sliver end can be influenced in that the stopped position can be varied somewhat.

As far as the device is concerned, the invention is carried out in that a traversing device of the flat can and a severing device are provided. Both are connected to machine controls of the draw frame. The mechanical severing device has several operating means. The device has the advantage that it can be realized at little cost.

In interaction between traversing device and severing device, the positioning of the fiber sliver requires no additional displacement process of the flat can. Unwinding of fiber sliver loops, which would affect quality in particular with combed cotton because of high adhesive friction, is avoided.

The invention is explained below through the accompanying drawings.

DETAILED DESCRIPTION OF THE PREFERRED EMBODIMENTS

Figure 1:
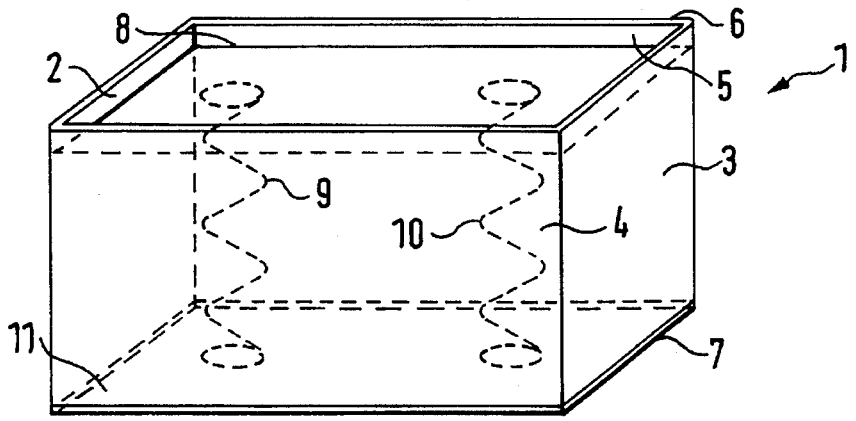
FIG. 1 shows the structure of a flat can.

Reference will now be made in detail to the present preferred embodiments of the invention, one or more examples of which are illustrated in the drawings. Each example is provided by way of explanation of the invention, not as a limitation of the invention. In fact, various modifications and variations can be made in the invention without departing from the scope or spirit of the invention. The numbering of components is consistent throughout the specification and drawings, with the same components having the same number throughout.

FIG. 1 shows the general structure of the flat can. The flat can 1 consists of the four horizontal walls, the end walls 2, 3 and the side walls 4, 5. The end walls form rounded corners with the side walls. Configurations in which the end wall is cambered and where there are no corners between side wall and end wall is however also possible. The flat can 1 has an upper can rim 6 and a lower can rim 7. One or several annular springs bear upon a can bottom 11. In the present case, two annular springs 9, 10 were used for example. The ring springs 9, 10 support the can plate 8. When the flat can is empty, the can plate 8 is positioned by the ring springs 9, 10 close below the upper can rim 6. The can plate 8 is in close contact with the walls so that it is pushed by the weight of the deposited fiber sliver against the force of the ring springs 9, 10 in the direction of the can bottom 11 as the deposit of fiber sliver increases. In this process it slides in horizontal position down against the can walls into a final position.

Figure 2:
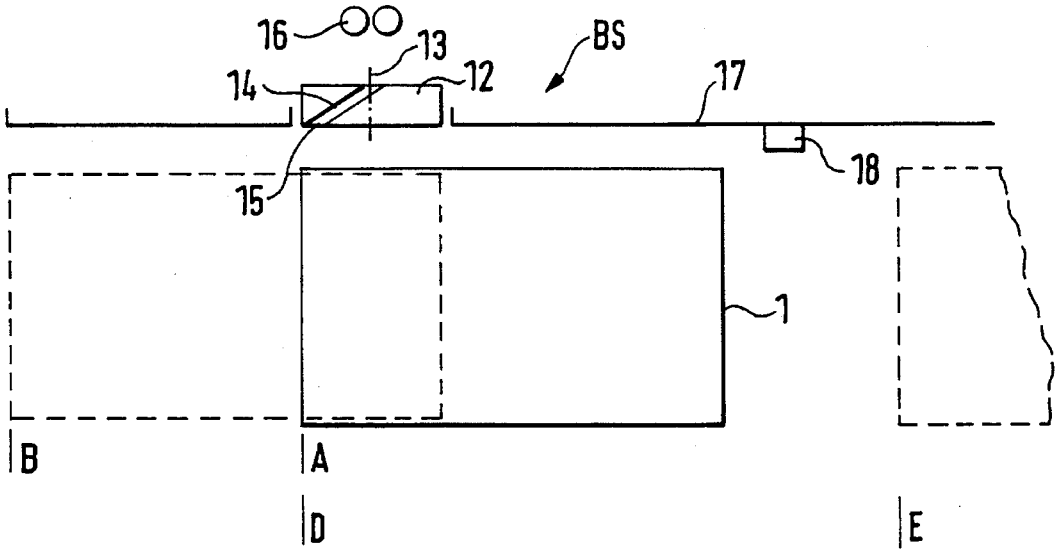
FIG. 2 shows the filling of the flat can on a draw frame.

FIG. 2 shows a schematic side view of such a flat can to be filled at a draw frame. The pair of calender rollers 16 and the rotary plate 12 in the machine table 17 constitute a pull-out component of the draw frame. This is the filling station BS. The traversing path of the flat can, the stopped position D of the flat can, the severing device 18, and the severing position E of the flat can are in the realm of the filling station BS. The rotary plate 12, which is mounted rotatably around the rotary axis 13, is stationary and installed in the machine table 17. The rotary plate 12 contains a sliver guiding channel 14. Next to the opening located below the pair of calender rollers 16,the sliver guiding channel 14 has an outlet 15 which points to the flat can 1. A severing device 18 to sever a fiber sliver is located below the machine table 17. FIG. 2 furthermore shows that the flat can 1 can be traversed below the rotary plate 12. The flat can 1 can be traversed between traversing position A and traversing position B.

Figure 3:
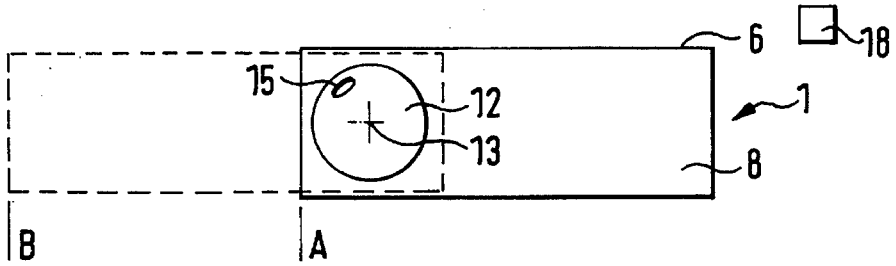
FIG. 3 shows the association of rotary plate and flat can.
Figure 4:
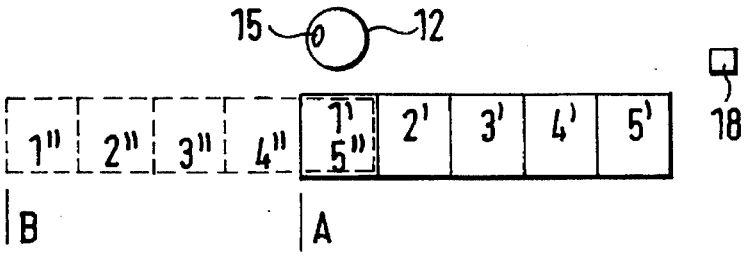
FIG. 4 shows the traversing position of the flat can.

For a better understanding of the process, an additional abstract of the interaction between rotary plate 12 and flat can 1 is presented. FIG. 3 shows the rotary plate 12 with its outlet 15 and, from that point of observation below, the can 1, whereby the can plate 8 and the upper can rim 6 which surrounds it can be identified. From this point of observation, it can be seen that it is possible to traverse the can between traversing positions A and B. This makes it possible for the rotary plate 12 to deposit fiber sliver in cycloidal form over the entire length of the can plate 8. The rotary plate executes a certain number of revolutions for the overall length of the can plate 8. For the sake of simplification and in order to clarify the principle further, it is assumed that a rotary plate 12 requires five revolutions for the traversing from traversing position A to traversing position B, and also five revolutions for the return from traversing position B to traversing position A. This condition is shown in FIG. 4 in an idealized form. Each of the shown sections (1'-5' and 1"-5") of the can plate 8 represents a complete revolution of the outlet 15 until the next section. As the flat can is moved from traversing position A into traversing position B, five complete rotations of the rotary plate outlet 15 are completed. This is depicted by sections 1", 2", 3", 4", 5". An analogous condition applies with the reverse movement of the flat can and is depicted by segments 1', 2', 3', 4', 5'.

Below are some explanations concerning the process according to the invention. A known measuring device to measure sliver length at the draw frame emits a signal indicating that the flat can has reached the desired degree of fullness. With this signal transmission, the draw frame still has difficulties in delivery. In preparation of the stoppage and subsequent severing of the sliver, the draw frame is switched over to a slower speed. The controls 40 according to FIG. 5 recognize this switching-over to a slower speed. For that purpose the controls 40 calculate the time of revolution of the rotary plate from the rotational speed of the rotary plate at the delivery speed. This calculation may be continuous for example, whereby the older value is compared with the current value and a characteristic magnitude is formed, so that the controls 40 detects a switch over to a lower speed from the deviation from characteristic magnitude. The position sensor 32 in proximity of the circumference of the rotary plate 12 supplies the corresponding signals for this, enabling the controls 40 to make the calculations.

The rotary plate 12 is switched over to a slower speed. This also applies to the speed of the flat can. The position sensors 30, 31 transmit the current position of the flat can on the traversing path. Based on the existing rotational speed of the rotary plate 12, the controls 40 calculate how many revolutions the rotary plate 12 would complete from the beginning of a braking event until it is stopped in position P. The time required for this is called the back-flow time. It should be pointed out that the number of revolutions of the rotary plate per time unit depends on the set speed at which the rotary plate 12 is rotating. As a function of this rotational speed, the rotary plate 12 has different back-flow times. Therefore, the appertaining back-flow times are calculated by the controls 40 for different rotational speeds of the rotary plate.

Starting from the beginning of the braking event, the outlet 15 of the rotary plate must have reached its defined position P at stoppage. The flat can has then also reached a position, advantageously traversing position A. This is advantageous because during the subsequent displacement of the flat can to the right in FIG. 3, in the direction of the severing device 18, the fiber sliver is drawn off immediately over the can rim 6 and is not drawn off across the deposited layer of the fiber sliver.

The position sensor 32 (FIG. 5) may be installed in proximity of the circumference of the rotary plate 12 where the outlet 15 must be positioned at stoppage, for example. For this purpose the contactor 150 of the position sensor 32 is installed in proximity of outlet 15. This arrangement is shown in FIG. 6. The controls 40 must now know the point in time for the beginning of braking so that the outlet 15 comes to a stop precisely across from the position sensor 32.

Figure 4A:
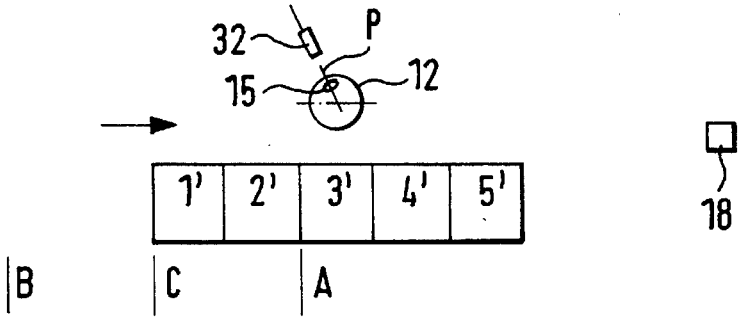
FIG. 4*a* shows the braking position of the flat can.
Figure 4B:
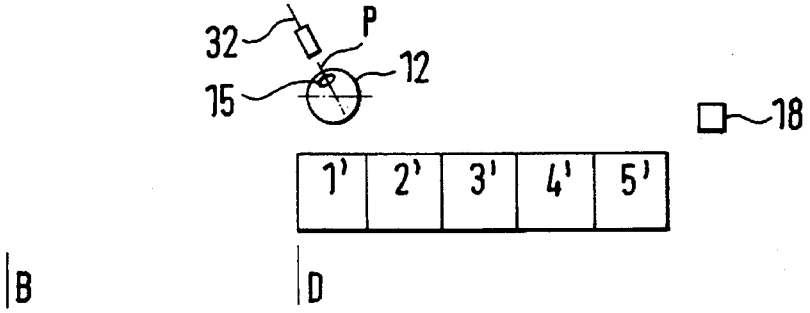
FIG. 4*b* shows the stopped position of the flat can.

If it was found, for example, that the outlet 15 requires two revolutions (corresponding to the back-flow time) to reach a desired position P when it stops, the controls 40 can furthermore calculate the point in time in the traversing of the flat can at which the signal must be given to begin braking. This situation is shown in FIG. 4*a*. The flat can requires a certain time for traversing between B and A. This time is reduced by the back-flow time and a starting time is obtained. When leaving the traversing position B, the flat can reaches braking position C at the end of the starting time. At the end of the starting time the position sensor 32 is actuated and as soon as it is approached by the contactor 150, a signal for the beginning of the braking process is triggered. The beginning of the braking process is marked by brake position C. It can be seen that part of the flat can is still at the left of the drawing of the traversing position A, i.e. that part of the flat can which will be standing exactly below the rotary plate 12 after expiration of the back-flow time, i.e. precisely after two revolutions of the outlet 15, and then assumes the position shown in FIG. 4*b*. FIG. 4*b* shows the stopped position D assumed by the flat can. This stopped position D was identical with traversing position A during traversing. The stopped position D is characterized in that the rotary plate 12 and the flat can 1 are stopped, whereby the outlet 15 of the rotary plate 12 has assumed a defined position P.

In practice, position P of the outlet 15 of the rotary plate 12, and thereby the stopped position D of the flat can, can be influenced slightly by internal machine influences, so that deviations from the stored value of the back-flow time may occur. Such an internal machine influence exists for instance in the start-up phase of the machine until it has reached operating temperature. In order to be able to compensate for this influence, it is calculated after how many revolutions (corresponds to a back-flow time) the outlet 15 of the rotary plate has actually stopped. The difference between the actual position of the outlet 15 of the rotary plate 12 and the desired position is found. This value is processed into a correction value which will be taken into account during the next deposit of the fiber sliver.

In another step of the process, the flat can is displaced from the stopped position D into a severing position E. This displacement can be carried out by the traversing device or by an additional transport shuttle of the can replacement device. The flat can covers displacement distance V in that case. Since the fiber sliver is deposited in loops, these loops of the last fiber sliver layer are in part drawn off again during the displacement of the flat can. This withdrawal takes place across the upper can rim 6 of the end wall, whereby the fiber sliver traverses at the rim of the end wall. Thereby the central area of the can rim 6 of the end walls 2, 3 is reached several times. The severing position E is reached when the flat can has passed the operating range of the severing device 18 and the drawn-off fiber sliver lies in the central area of the upper can rim 6 of an end wall. The severing device 18 was installed in such a position relative to the severing position E of the flat can, that the fiber sliver is given a defined length after clamping and severing by the severing device 18 and comes to lie in the central area of the upper can rim 6.

The central area of the upper can rim 6 comprises a zone of approximately one fiber sliver thickness next to the longitudinal can axis, whereby the width of the central area is variable by the length of displacement distance V. This defined deposit of the fiber sliver end provides the advantage, at minimal construction costs, that the fiber sliver end is found automatically and is ready for further processing after the transportation of the flat can from severing position E to the spinning machine. Thus the devices on a can transportation system or on the spinning machine which must prepare or ready the fiber sliver for automatic further processing are omitted. In the process according to the invention the previously used holding devices on the flat can are also omitted.

Figure 4C:
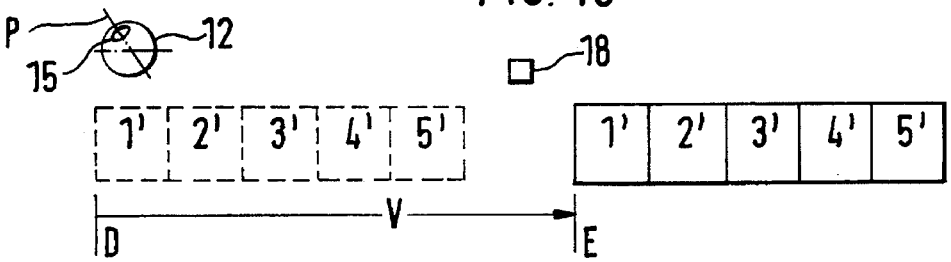
FIG. 4*c* shows the severing position and the displacement path of the flat can.
Figure 5:
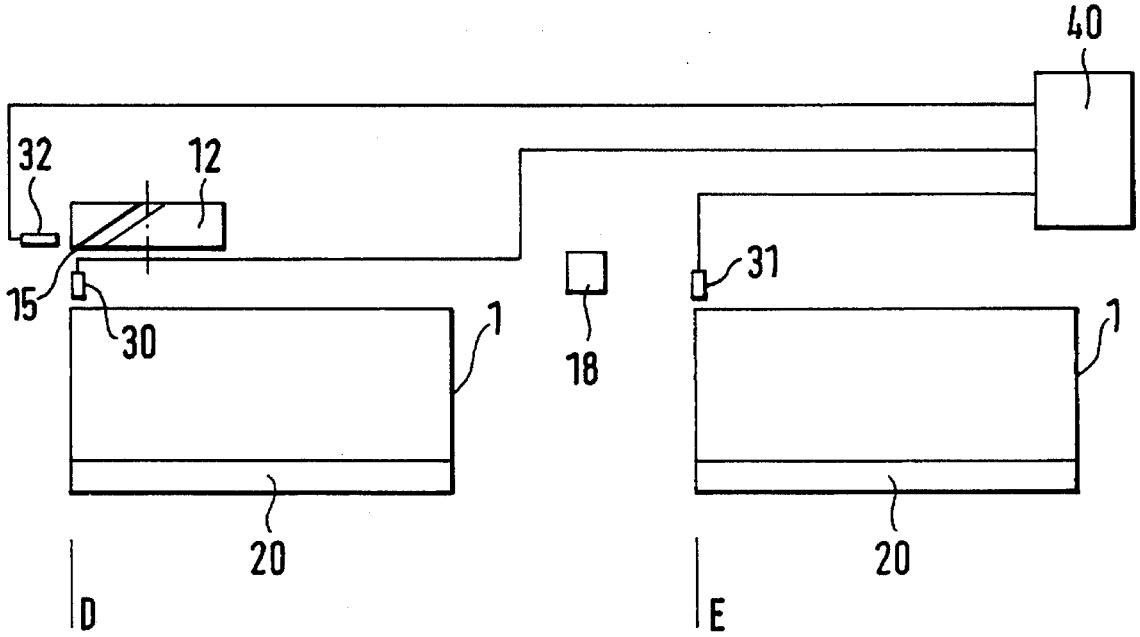
FIG. 5 shows position sensors.
Figure 6:
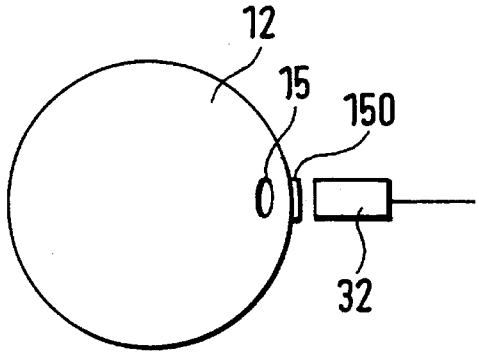
FIG. 6 shows position sensor on the rotary plate.

FIG. 5 shows an embodiment of the device according to the invention. The flat can 1 is located on a traversing device 20. This known traversing device 20 carries out the traversing between traversing position A and traversing position B (FIG. 2). Thereby the flat can 1 is also brought into stopped position D by the traversing device 20. In the example of FIGS. 4–4*c* the traversing position A is identical with the stopped position D, for example. The stopped position D is controlled by the position sensor 30. The flat can 1 can also be pushed into severing position E by means of the traversing device 20. The severing position E is determined by the position sensor 31.

The number of revolutions of the rotary plate is determined by means of the position sensor 32. The position sensors 30, 31, 32 transmit their signals via electrical connections to controls 40. The position sensors may operate with or without contact. This depends on the physical detection principle used. Normally a proximity sensor is used which is actuated via a metal switching flag and which is mounted on the rotary plate 12 or on the flat can 1 or the traversing device.

Another advantageous embodiment of the invention is explained through FIGS. 7 through 9*d*.

Figure 7:
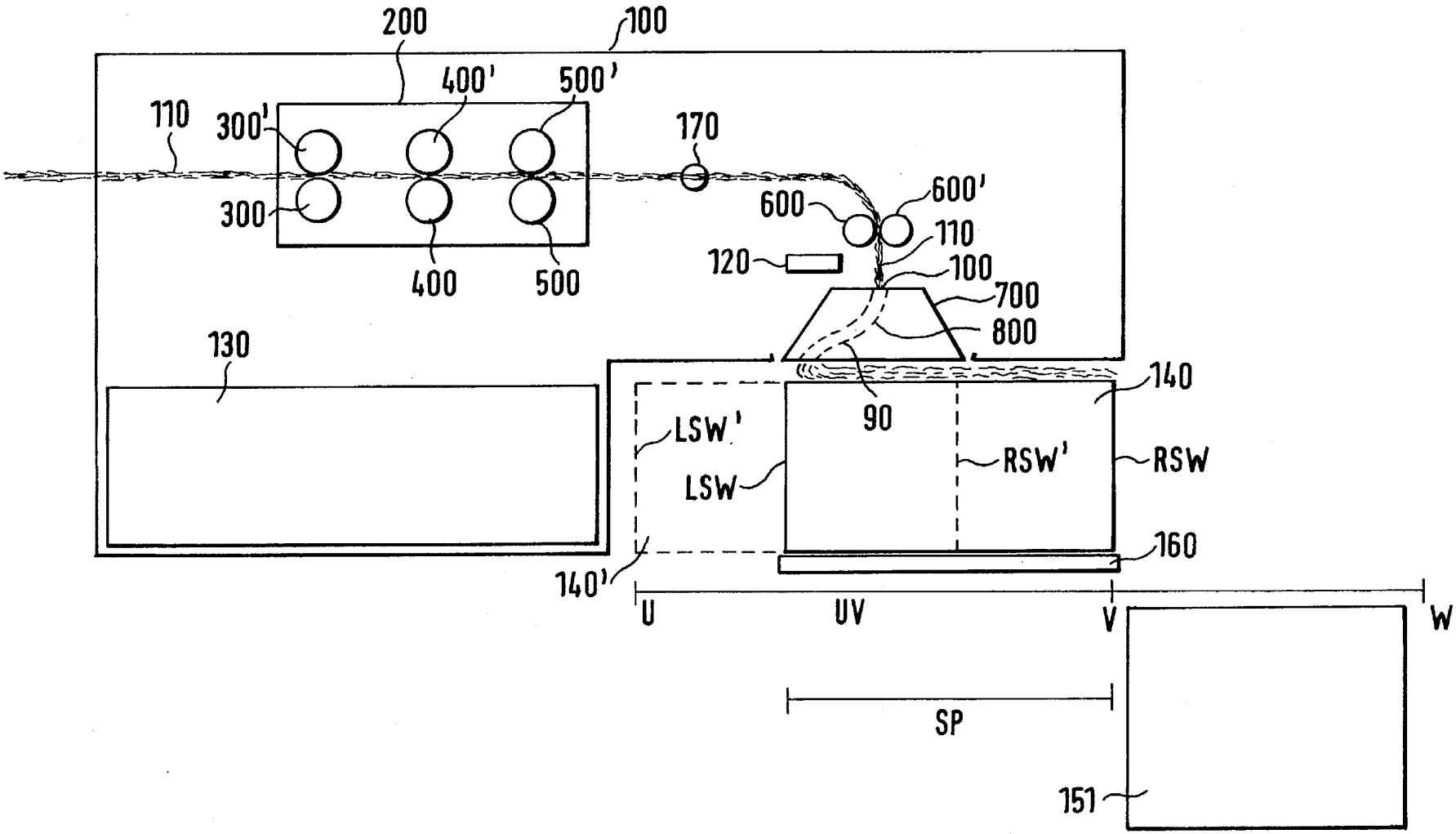
FIG. 7 shows another advantageous embodiment of the positioning between outlet of the rotary plate, flat can, and severing device.

FIG. 7 schematically shows a draw frame 100 in the textile industry, as well as a flat can 140 and traversing device 160 as well as buffer 151 of a conveying system for flat cans. In the draw frame 100 the fiber sliver 110 is drafted in drawing equipment 200. The drawing equipment 200 is represented by the drawing roller pairs 300, 300'; 400, 400'; 500, 500'. At the output of the draw frame 200 is a measuring element 170 to measure the delivered fiber sliver length. The fiber sliver 110 is delivered to a pair of calender rollers 600, 600' and is conveyed by the pair of calendar rollers 600, 600' into a sliver guiding channel 800 of a rotary plate 700. The rotary plate 700 rotates so that the fiber sliver is deposited via its outlet 90 in a flat can 140 standing below. The flat can 140 has a rectangular base surface. When it is empty a movable can plate is located below or at the level of the upper can rim. As the filling of the can progresses, the can plate is moved against the force of a spring below it in the direction of the can bottom. The flat can 140 has narrow end walls, the end wall LSW and the end wall RSW. The flat can is located on a traversing device 160. The traversing device 160 has a drive (not shown) with associates control device. During the filling process, the flat can 140 is traversed below the rotary plate between the two cuspidal points U and V of its traversing path UV. The flat can thus moves between the two shown positions of the flat can 140 and the flat can 140' (broken line). The rotation of the rotary plate 700 and the traversing of the flat can causes the fiber sliver to be deposited cycloidally on the can plate of the flat can. The depositing goes from one end wall of the flat can to the other end wall and vice versa. A depositing distance from one end wall to the other constitutes one layer of fiber sliver loops. A full flat can 140 has a plurality of such layers. The start-up, the operation, and the braking of rotary plate and flat can are synchronized.

When the measuring element 170 records the attained limit value of the delivered fiber sliver length to measure the delivered sliver length, it transmits at the same time a signal to the machine controls 130 (represented diagrammatically). The machine controls causes the drive of the rotary plate 700 and the traversing device 160 to stop there associated devices at a defined point in time. This stoppage is carried out in such a manner that the flat can 140 reaches a position near or in the cuspidal point V when it is stopped, i.e. the end wall RSW is standing near or in the cuspidal point V and the end wall LSW stands in the area below the rotary plate 700. The flat can 140 is thus in stopped position SP on the traversing path UV. This stopped position SP could be varied to a certain degree by stopping near the cuspidal point. The length of the sliver end can be influenced thereby.

Figure 8:
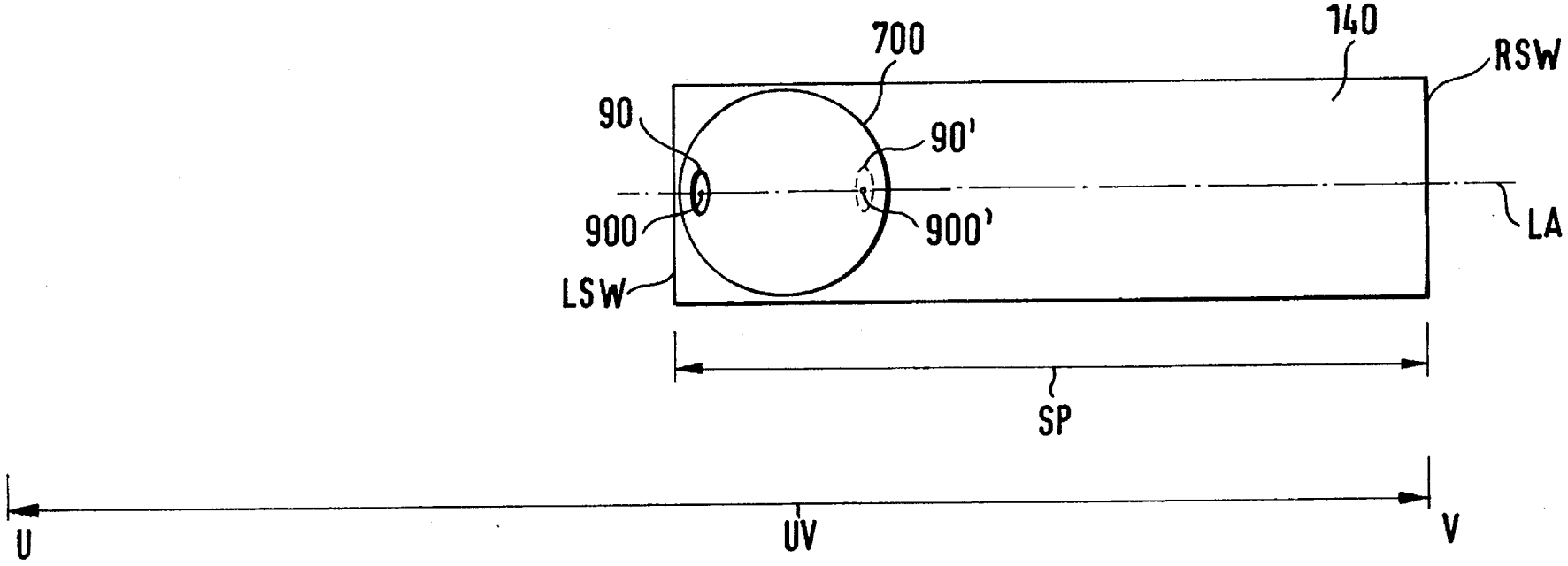
FIG. 8 shows the association of the outlet of the rotary plate with the flat can.

FIG. 8 schematically shows the assignment of the rotary plate 700 from above. The flat can 140 is in stopped position SP on the traversing path UV. The rotary plate 700 is located above the flat can 140. The position of the rotary plate in relation to the stopped position SP of the flat can 140 is positioned, i.e. the rotary plate 700 is always stopped so that the outlet 90 of the sliver guiding channel 800 always comes to a stop in the same position. The position of the outlet 90 is adjusted so that the fiber sliver 110 is held at a plumb vertical to the longitudinal axis LA. This corresponds to the position 900 of the outlet 90. A second possibility exists if the rotary plate reaches position 900' with its outlet 90' as it is rotated by 180°. Other positions of the rotary plate outlet 90 are however also possible. The selection of other position depends on the desired point of deposit on the end wall.

Figure 9:
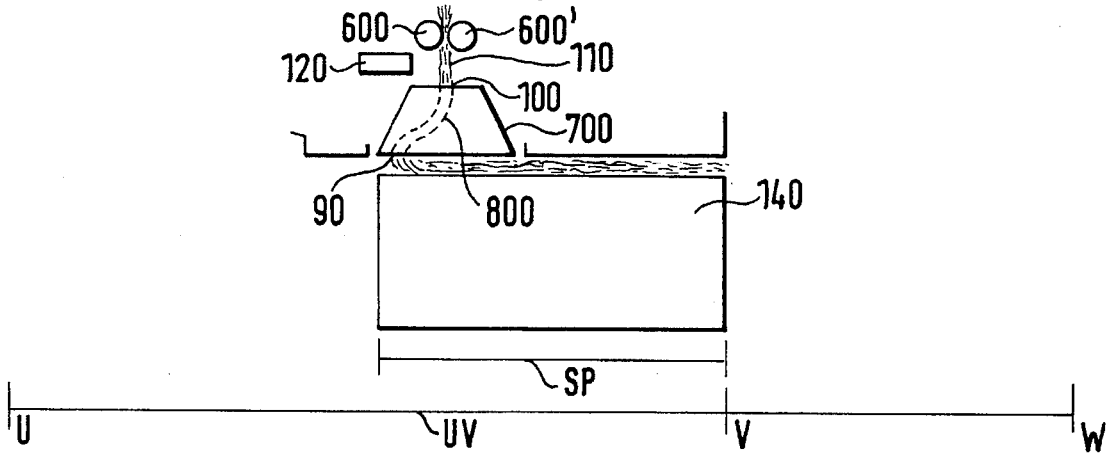
FIG. 9 shows the flat can in the stopped position.

A characteristic which is essential to the process is achieved, i.e. that the flat can 140 is stopped in stopped position SP (FIG. 9). At the same time the delivery of fiber sliver 110 by the pair of calender rollers 600, 600' is stopped. This stop is caused by the machine controls 130. The fiber sliver hangs in the sliver guiding channel and lies in the flat can 140. The severing device 120 now receives the signal from the machine controls 130 that the fiber sliver is to be severed between the pair of calendar rollers 600, 600' and the input opening 100 of the sliver guiding channel 800. The mechanical sliver severing device 120 severs the fiber sliver at this point.

Figure 9A:
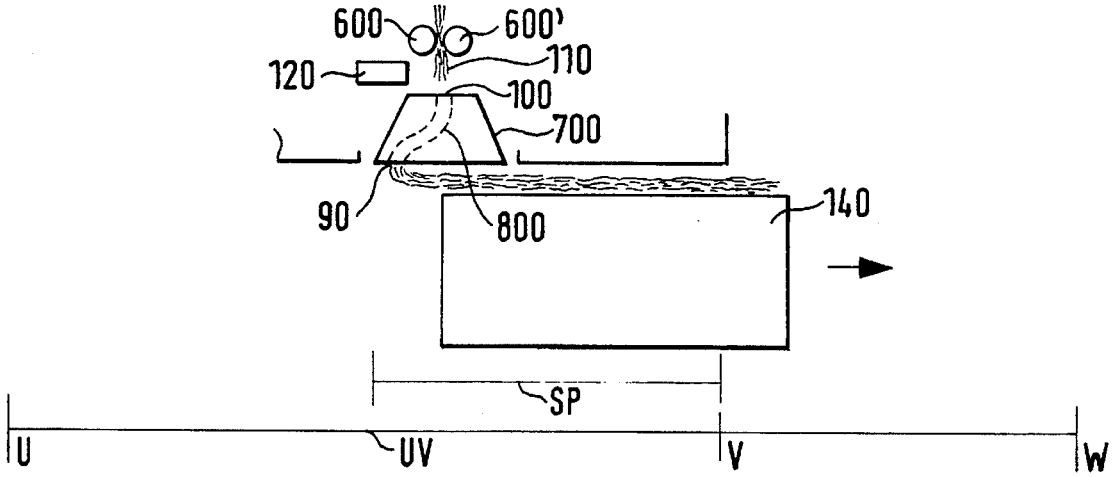
FIG. 9*a* shows the displacement of the flat can from its stopped position.
Figure 9B:
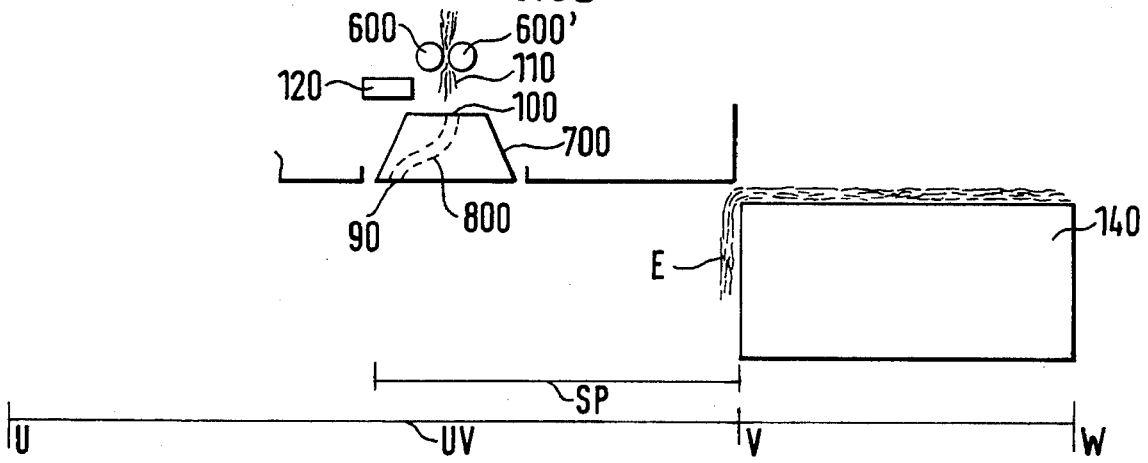
FIG. 9*b* shows the flat can in the receiving position.
Figure 9C:
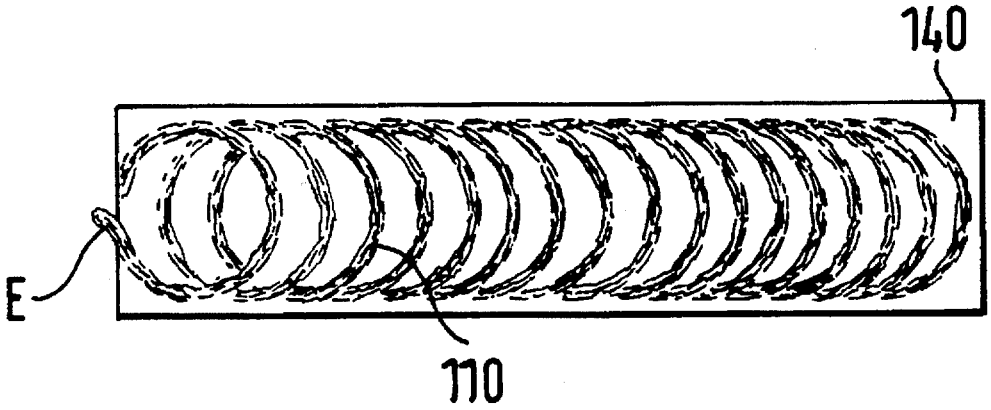
FIG. 9*c* shows the position of the sliver end.
Figure 9D:
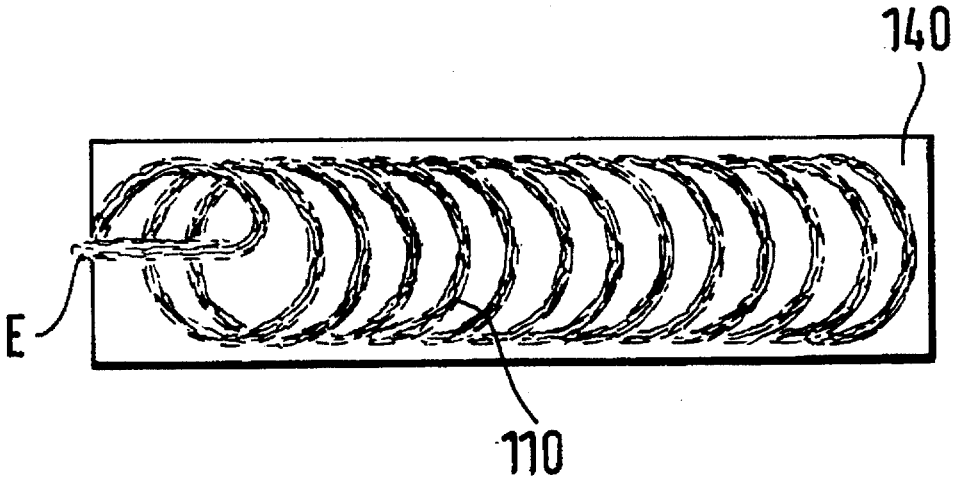
FIG. 9*d* shows another position of the sliver end.

FIG. 9*a* shows that the flat can 140 is now displaced from its stopped position SP in the direction of a transfer position W. It can be seen here that the fiber sliver end is pulled by the movement of the can from the sliver guiding channel 800. In FIG. 9*b* the can 140 has reached the transfer position W. The fiber sliver end E hangs down on the end wall LSW of the flat can 140. Since the rotary plate 700 was positioned with its opening 90 in the longitudinal axis LA (position 900), the fiber sliver end E is deposited in the central area of the end wall LSW (FIG. 9*c*).

If the rotary plate 700 is positioned with its outlet in position 900' in relation to the longitudinal axis LA (compare with FIG. 8), the fiber sliver end E is deposited so as to lie above the loop in the central area of the end wall.

It will be apparent to those skilled in the art that various modifications and variations can be made in the present invention without departing from the scope or spirit of the invention. For example, features illustrated or described as part of one embodiment can be used on another embodiment to yield a still further embodiment. It is intended that the present invention cover such modifications and variations as come within the scope of the appended claims and their equivalents.

We claim:

1. An apparatus for precisely depositing a predetermined length of an end of a fiber sliver on a flat can, said apparatus comprising a rotary plate having a sliver guiding channel and an outlet defined therein and a pair of calendar rollers for conveying the fiber sliver through said sliver guiding channel to be deposited from said outlet in cycloidal loops in a flat can traversing thereunder; said apparatus further comprising a traversing device for moving the flat can between any combination of a stopped position, along a displacement: path to a severing position, and to a final transfer position; said apparatus comprising a severing device for severing the fiber sliver at said severing position thereby defining a fiber sliver end having a predetermined desired length; and said apparatus further comprising a control device configured to control and coordinate positions of said rotary plate outlet, said traversing device, and said severing device so that upon braking of said flat can to said stopped position, said rotary plate is slowed accordingly so that said outlet is positioned at a predetermined position with respect to the longitudinal axis of said flat can, said control device further coordinating severing of said fiber sliver at said severing position so that a predetermined length of fiber sliver end is severed and deposited on and end wall of said flat can upon said flat can being conveyed from said stopped position to said final transfer position.

2. The apparatus as in claim 1, wherein said traversing device is configured to convey said flat can along a displacement path between said stopped position and said severing position, said severing device disposed between said stopped position and said severing position.

3. The apparatus as in claim 1, wherein said control device further comprises position sensors for sensing and transmitting the relative positions of said rotary plate and said traversing device.

4. The apparatus as in claim 3, wherein at least one said position sensor is disposed near the circumference of said rotary plate for sensing the position of said outlet.

5. The apparatus as in claim 3, wherein at least one said position sensor is operatively configured with said traversing device for sensing said stopped position of said flat can.

6. The apparatus as in claim 3, wherein at least one said position sensor is operatively configured with said traversing device for sensing said severing position of said flat can.

7. The apparatus as in claim 1, wherein said severing device is operatively disposed between said calendar rollers and said sliver guiding channel of said rotary plate, said fiber sliver being severed at said stopped position of said flat can and being pulled from said sliver guiding channel upon subsequent movement of said traversing device and flat can from said severing position to said final transfer position.

8. The apparatus as in claim 1, wherein said control device is configured to control and coordinate positions of said rotary plate outlet, said traversing device, and said severing device so that upon braking of said flat can to said stopped position said rotary plate is slowed accordingly so that said outlet is aligned with the longitudinal axis of said flat can.

* * * * *